US006856287B2

(12) United States Patent
Rao et al.

(10) Patent No.: US 6,856,287 B2
(45) Date of Patent: Feb. 15, 2005

(54) TRIPLE BAND GPS TRAP-LOADED INVERTED L ANTENNA ARRAY

(75) Inventors: B. Rama Rao, Lexington, MA (US); Michael Smolinski, Lowell, MA (US); Cuong Quach, Nashua, NH (US); Eddie N. Rosario, Methuen, MA (US)

(73) Assignee: The Mitre Corporation, McLean, VA (US)

( * ) Notice: Subject to any disclaimer, the term of this patent is extended or adjusted under 35 U.S.C. 154(b) by 59 days.

(21) Appl. No.: 10/417,748

(22) Filed: Apr. 17, 2003

(65) Prior Publication Data

US 2004/0233106 A1 Nov. 25, 2004

(51) Int. Cl.[7] ..... H01Q 1/24

(52) U.S. Cl. ..... 343/700 MS; 343/722; 343/749

(58) Field of Search ..... 343/700 MS, 722, 343/745, 749, 751, 752, 853

(56) References Cited

U.S. PATENT DOCUMENTS

| | | | | | |
|---|---|---|---|---|---|
| 3,622,890 | A | * | 11/1971 | Fujimoto et al. | 455/291 |
| 5,138,651 | A | * | 8/1992 | Sudo | 455/462 |
| 5,349,361 | A | * | 9/1994 | Egashira et al. | 343/715 |
| 6,323,821 | B1 | * | 11/2001 | McLean | 343/795 |
| 6,483,463 | B2 | * | 11/2002 | Kadambi et al. | 343/700 MS |
| 6,720,935 | B2 | * | 4/2004 | Lamensdorf et al. | 343/895 |
| 6,734,828 | B2 | * | 5/2004 | Shor | 343/795 |

* cited by examiner

*Primary Examiner*—Tho Phan
(74) *Attorney, Agent, or Firm*—Choate Hall & Stewart

(57) ABSTRACT

The antenna includes four elements excited with equal amplitudes but with a relative phase difference of 0°, −90°, −180°, and −270°. Each element includes a vertical and horizontal portion. An RF trap filter is located within the horizontal portion so that the antenna provides good gain coverage at all three frequency bands of a modernized global positioning system.

13 Claims, 6 Drawing Sheets

Far-field amplitude of Dsph231a2.nsi

Far-field amplitude of Dsph231a2.nsi

TRIPLE BAND GPS TRAP-LOADED INVERTED L ANTENNA ARRAY

BACKGROUND OF THE INVENTION

This invention relates to antenna arrays, and more particularly to a triple-band, trap loaded antenna for GPS use.

The global positioning system (GPS) includes a constellation of satellites in low earth orbit. These satellites emits signals allowing a receiver to determine its position very accurately. The current GPS system utilizes signals in two frequency bands referred to as $L_1$ and $L_2$. Signals in the $L_1$ band are centered at 1575.42 MHz and signals in the $L_2$ band are centered at 1227.60 MHz. These signals, available for both civilian and military users, have a 20 MHz bandwidth with a proposed extension to 24 MHz to accommodate a new military M-code that will be inserted into new GPS Block IIF satellites scheduled for launch beginning in 2005. These new GPS Block IIF satellites will also carry a new signal frequency band designated as $L_5$ and located at 1176.45 MHz with a 20 MHz bandwidth. This new signal referred to as the "safety of life" navigation signal will allow precision approach navigation on a world-wide basis and provide mitigation against interference. Thus, the modernized GPS system will require receivers responsive to all three frequency bands $L_1$, $L_2$ and $L_5$. Such receivers, therefore, will require an antenna system with good gain coverage at all three frequency bands over the required bandwidth.

A known GPS antenna is a dual-frequency quadriflar helix antenna developed at the Mitre Corporation, assignee of this patent application. This antenna employs RF trap loading. See, D. P. Lamensdorf, M. Smolinski, "Dual Frequency Quadrifilar Helix Antenna" proceedings 2002, IEEE-APS International Symposium, San Antonio, Tex., Vol. 3, paper 87.5, pp. 488–491. This antenna is also the subject of a co-owned patent application, Ser. No. 10/174,330 filed Jun. 18, 2002. Trap loading has also previously been used by amateur radio operators for increasing the bandwidth of monopole and dipole antennas operating in the HF and VHF bands. See, "The ARRL Antenna Handbook," $15^{th}$ Edition, Published by The American Relay League, Newington, Conn., 1988, pp. 7–8 to 7–14.

Inverted L antennas are also known. Such antennas are compact, low profile transmission line type antennas that have been used in various forms for missiles, vehicular communication systems, and in mobile telephone systems. See, R. W. P. King, C. W. Harrison, "Transrnission Line Antennas with Application to Missiles" in "Antennas and Waves," The MIT Press, 1969, pp. 437–481; K. Fujimoto, A. Henderson, J. R. James, "Inverted L Antennas" in "Small Antennas," Section 2.4, John Wiley & Sons, 1987, pp. 116–151; K. Fujimoto, J. R. James, "Mobile Antenna Systems Handbook," ARTECH House Publishers, 1994, pp. 217–228.

A trap loaded Planar Inverted F Antenna (PIFA), a variant of the inverted L antenna, has also recently been designed for operation at 900 MHz (cellular systems) and 1800 MHz (personal communication systems). See, G. H. K. Lui, R. D. Murch, "Compact Dual-Frequency PIFA Designs Using LC Resonators," IEEE Transactions on Antennas and Propagation, Vol. 49, No. 7, July 2001, pp. 1016–1019 and A. K. Shriverik, J.-F. Zurcher, O. Staub and J. R. Mosig, "PCS Antenna Design: The Challenge of Miniaturization," IEEE Antennas and Propagation Magazine, Vol. 43, No. 4, August 2001, pp. 22–23.

SUMMARY OF THE INVENTION

According to one aspect, the antenna array of the invention includes four elements arranged at 90° intervals on a dielectric substrate. Each element includes first (horizontal) and second (vertical) portions disposed at a substantially right angle with respect to one another and the first portion includes an RF trap filter. Each element is adapted to operate at three frequency bands and the elements are excited with equal amplitudes but with a relative phase difference of 0°, −90°, −180° and −270° to achieve right-hand circular polarization. The RF trap filter presents a high impedance with respect to one of the three frequency bands. In one embodiment, the three frequency bands include two bands relatively closely separated from each other with a third band more widely separated from the other two bands. In this embodiment, the RF trap filter presents a high impedance with respect to the third band. In a preferred embodiment, the three frequency bands are GPS bands. Such bands are approximately centered on 1176, 1227, and 1575 MHz and the trap filter is adapted to bring each of the four elements into resonance at approximately 1575 MHz.

In a preferred embodiment, the dielectric constant of the dielectric substrate is approximately 1.07. In this embodiment, the sum of the lengths of the first and second portions equals approximately $\lambda/4$ in which $\lambda$ is wavelength. The RF trap filter is preferably a circuit having a capacitor in parallel with an inductor. It is preferred that the inductor be a high Q inductor. For use of the antenna array of the invention for modernized GPS, the capacitor has a capacitance of 2.2 picofarad and the inductor has an inductance of 2.8 nanohenry. A suitable dielectric substrate is in the form of a square with an element disposed in the middle of each side of the square.

DESCRIPTION OF THE PREFERRED EMBODIMENT

Figure 1:
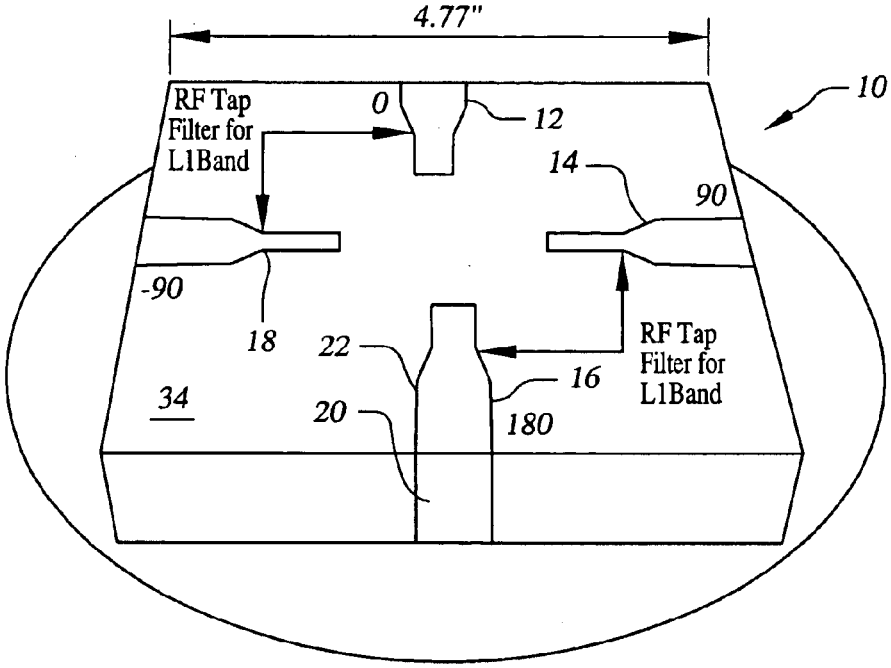
FIG. 1 is a perspective view of the antenna array of the invention.
Figure 2:
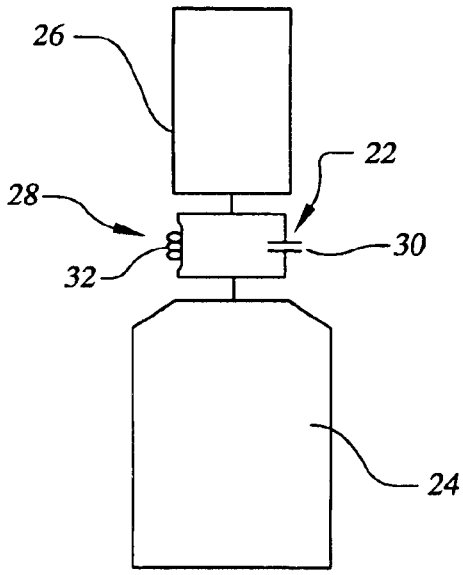
FIG. 2 is a schematic illustration showing a RF trap filter embedded in one of the elements of the array.

With reference first to FIG. 1, an antenna array 10 according to the invention includes four trap loaded, inverted L antenna elements 12, 14, 16, and 18. Each of the antenna elements includes a vertical portion and a horizontal portion. For example, as can be seen in FIG. 1, the antenna element 16 includes a vertical portion 20 and a horizontal portion 22. The horizontal portion 22 is illustrated schematically in FIG. 2. The horizontal portion 22 includes a wider portion 24 and a narrower portion 26 connected by an RF trap circuit 28 that includes a capacitor 30 and inductor 32 connected in parallel. Each of the antenna elements 12, 14, 16, and 18 includes an RF trap circuit 28.

Each of the antenna array elements 12, 14, 16, and 18 is mounted on a dielectric substrate 34. The substrate 34 in this embodiment is approximately 4.77 inches square and has a thickness of 0.87 inches. A suitable substrate is foam having a low dielectric constant of approximately 1.07 such as Rohacell foam. The elements 12, 14, 16, and 18 are fabricated from a suitable conductor such as copper. As will be discussed below, each of the elements 12, 14, 16, and 18 can be designed to operate at the three frequency bands of a modernized GPS system, namely, $L_1$, $L_2$, and $L_5$.

Each of the elements 12, 14, 16, and 18 typically have an elliptically polarized far field pattern with both vertical and horizontal polarization components provided by the short vertical element 20 and the longer horizontal element 22. To achieve right-hand circular polarization (RHCP) over a large portion of the upper hemisphere that is needed for receiving signals from the various GPS satellites, the four inverted L antenna elements of the array are arranged around the square substrate 34 at 90° intervals as illustrated in FIG. 1 and excited with equal amplitudes but with a relative phase difference of 0°, −90°, −180°, and −270° (or plus 90°). Such a phased distribution between the array elements 12, 14, 16, and 18 was obtained by means of a compact microstrip feed network (not shown) including a 180° "rat race" hybrid, the two outputs of which were connected to compact, surface mounted 90° hybrids. This type of feed excitation provides good RHCP gain for the inverted L antenna array over much of the upper hemisphere allowing it to acquire GPS satellites at elevation angles as low as 10°. Acquisition of low elevation GPS satellites allows for a lower RMS position error in range.

The input impedance of the inverted L antenna elements can be brought into resonance by adjusting the length of the horizontal portion 22 and the height of the vertical portion 20 so that their sum equals $\lambda/4$ where $\lambda$ is the wavelength. See, R. W. P. King, C. W. Harrison, "Transmission Line Antennas with Application to Missiles" in "Antennas and Waves," The MIT Press, 1969, pp. 437–481; K. Fujimoto, A. Anderson, J. R. James, "Inverted L Antennas" in "Small Antennas," Section 2.4, John Wiley & Sons, 1987, pp. 116–151.

Each element of the antenna array 10 can be made to resonate in the $L_1$ frequency band by placing the RF filter trap 28 tuned to 1.5754 GHz at a selected position along the horizontal portion 22 of each of the four inverted L elements of the array. The RF trap 28 load presents a very high impedance in the $L_1$ band at the point in the antenna where the filter is placed. That is, a signal in the $L_1$ GPS frequency band will not "see" the portion 26 of the horizontal element 22 but rather the shorter portion 24.

Figure 3:
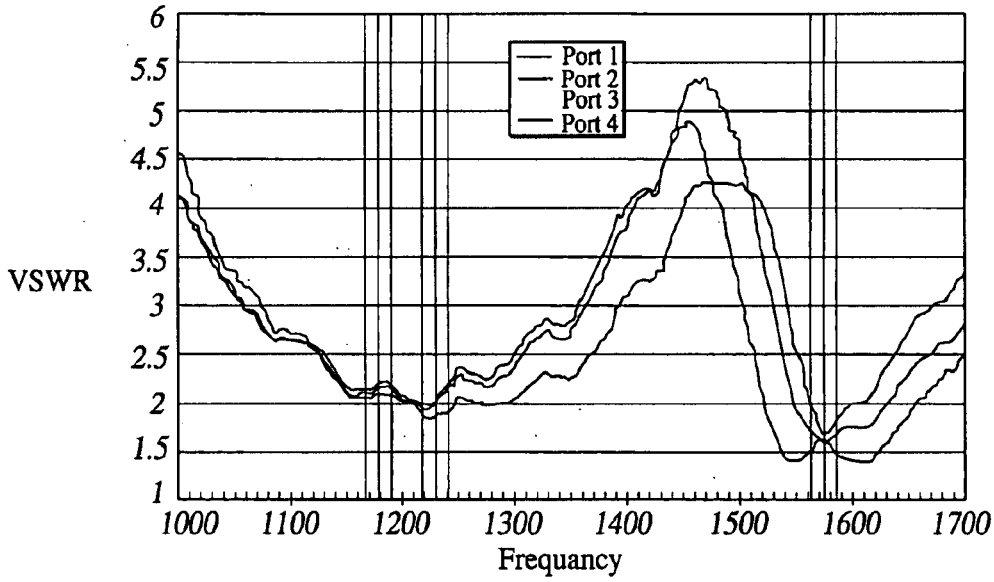
FIG. 3 is a graph of voltage standing wave ratio (VSWR) versus frequency.

In a preferred embodiment, the RF trap filter 28 included a 2.2 picofarad capacitor 30 in parallel with a 2.8 nanohenry high "Q" inductor 32. These values for the filter inductance and capacitance were selected through experimental measurements of voltage standing wave ratio (VSWR) to bring the antenna into resonance as close as possible to 1.5754 GHz, the center frequency of the of the $L_1$ band. FIG. 3 is a graph of VSWR vs. frequency. It should be noted that the 2.2 picofarad capacitance of the capacitor 30 is lower than 3.6 picofarad, the capacitance value that can be calculated to achieve parallel resonance at the design frequency of 1.5754 GHz. Additional capacitance is provided by the gap capacitance between the two segments 24 and 26 of the antenna line where the trap filter 28 is placed. The antenna at this juncture can be treated as a section of a microstrip line for the purpose of this evaluation. See, Reinmut K. Hoffman, "A Gap in the Strip Conductor" in "Handbook of Microwave Integrated Circuits," ARTECH House, 1987, pp. 306–309. The gap in the microstrip line can be represented as a series capacitance between two parallel capacitances.

The trap filter 28 also acts as an inductive load at the $L_2$ and $L_5$ bands for the remaining length of the antenna since these frequencies are below the resonant frequency of the trap filter; the inductive loading shortens the length of the antenna that is needed beyond the filter to achieve resonance in these two lower frequency bands. To compensate for the inductive loading introduced by the trap filter 28, the length of the antenna arm 26 beyond the trap load filter 28 is adjusted through VSWR measurements to bring the antenna into resonance in the $L_2$ and $L_5$ frequency bands. Our experimental investigations indicate that an additional trap load toward the $L_2$ frequency was not needed since the resonance provided by the antenna arm extension 26 beyond the $L_1$ trap filter 28 was broad enough to cover both the $L_2$ and $L_5$ bands. Since the inductor 32 in the trap load filter 28 has a finite Q, the small resistance associated with the inductor broadens the resonance enough to achieve near resonance conditions in both the $L_2$ and the $L_5$ bands. The performance of the antenna of the invention was independently verified through a Method of Moment analysis using the NEC electromagnetic code.

Figure 4A:
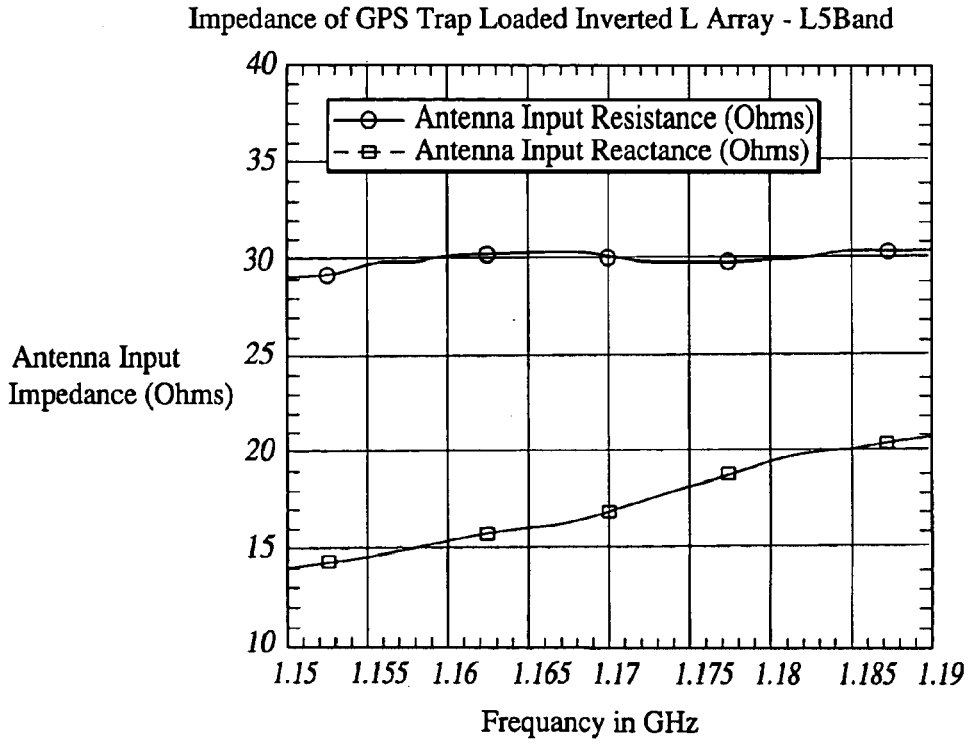
FIG. 4*a* is a graph of antenna input resistance and reactance as a function of frequency for the $L_5$ band.
Figure 4B:
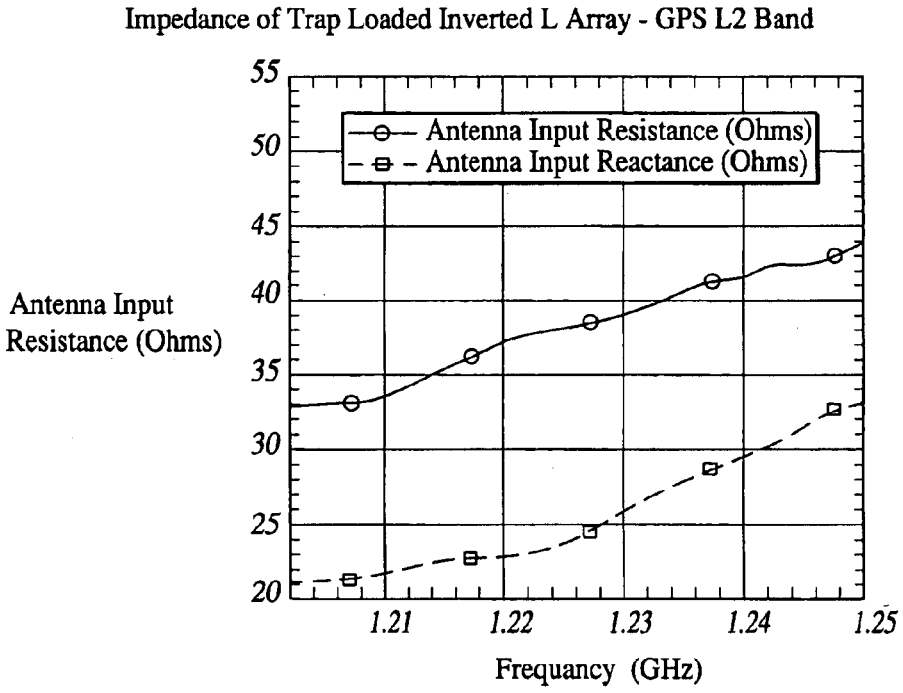
FIG. 4*b* is a graph of antenna input resistance and reactance as a function of frequency for the $L_2$ band.
Figure 4C:
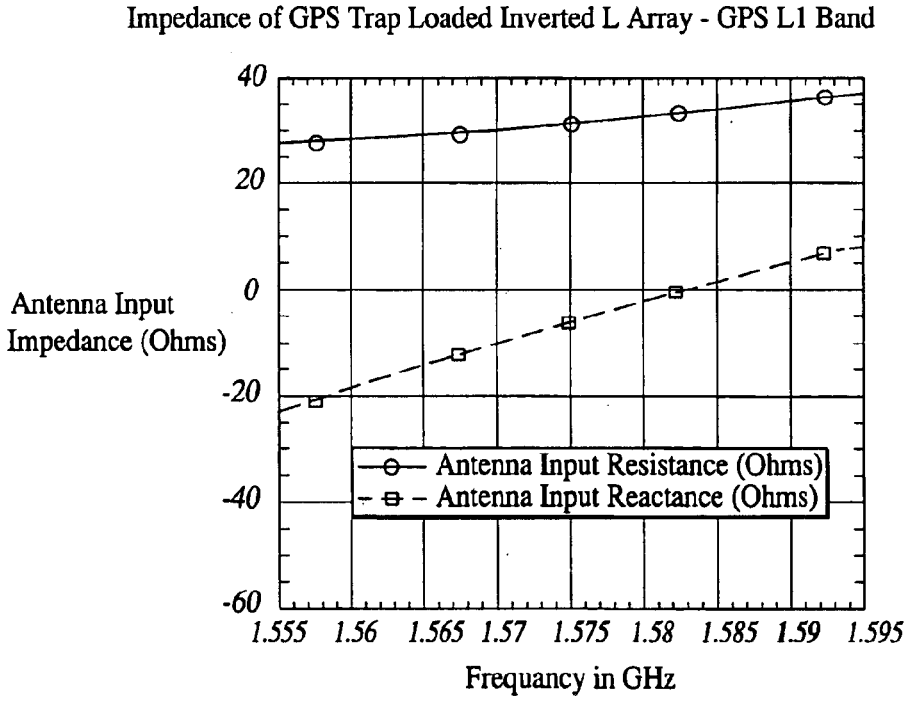
FIG. 4*c* is a graph of antenna input resistance and reactance as a function of frequency for the $L_1$ band.
Figure 5A:
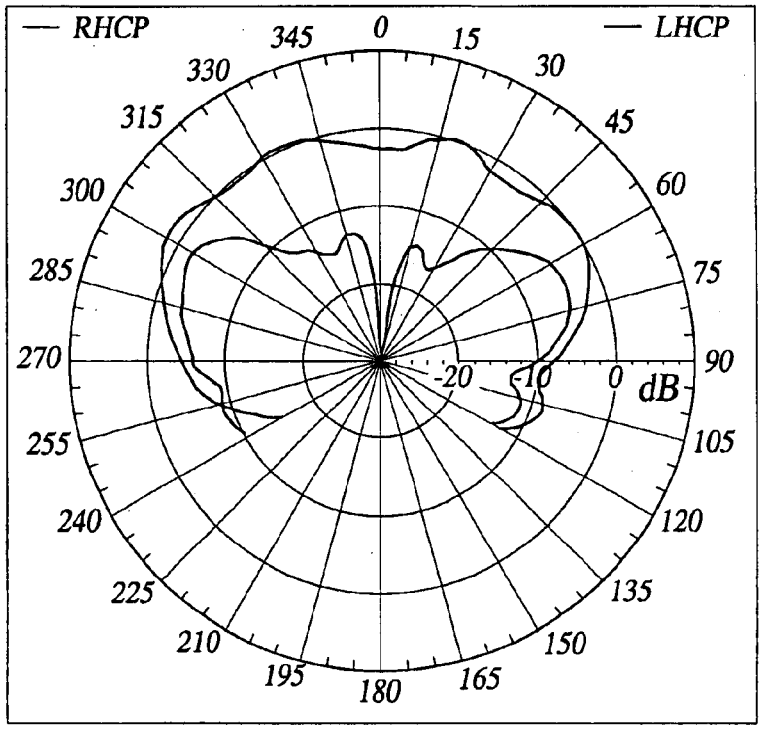
FIG. 5*a* is a polar plot showing measured right-hand circular polarization and left-hand circular polarization far-field radiation patterns for the $L_5$ band.
Figure 5B:
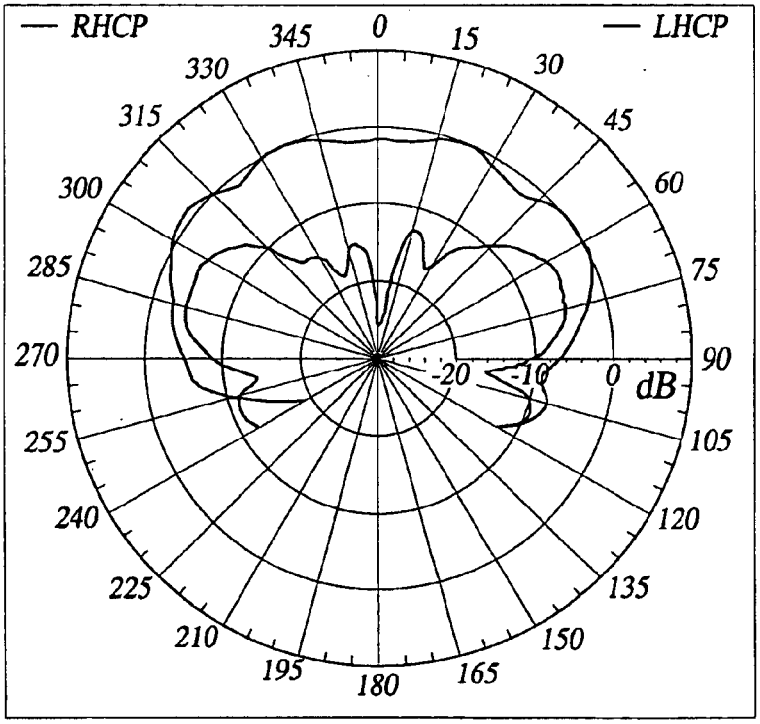
FIG. 5*b* is a polar plot showing measured right-hand circular polarization and left-hand circular polarization far-field radiation patterns for the $L_2$ band.
Figure 5C:
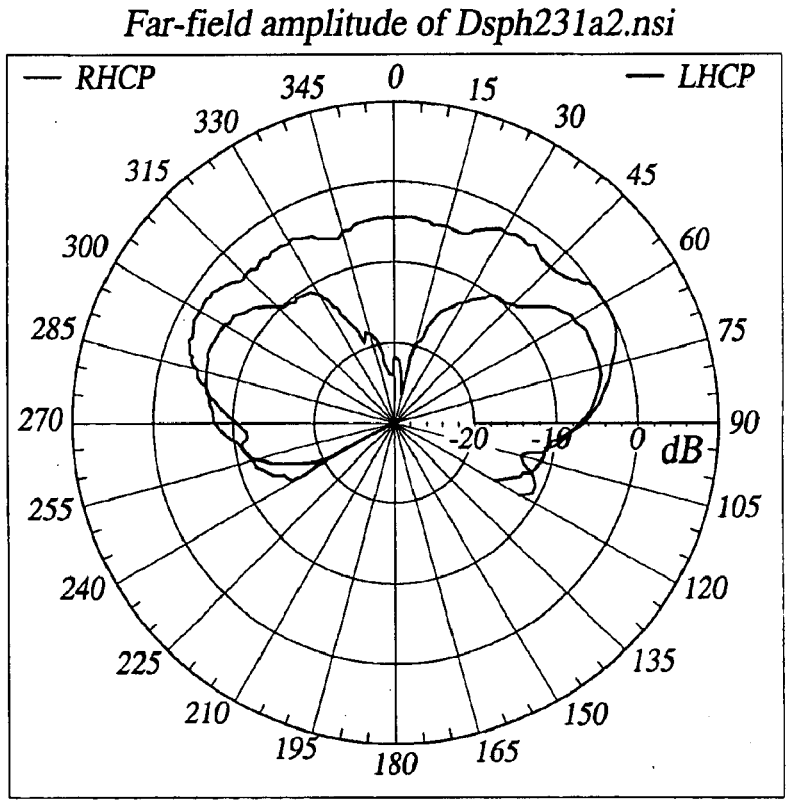
FIG. 5*c* is a polar plot showing the measured right-hand circular polarization and left-hand circular polarization far-field radiation patterns for the $L_1$ band.
Figure 6A:
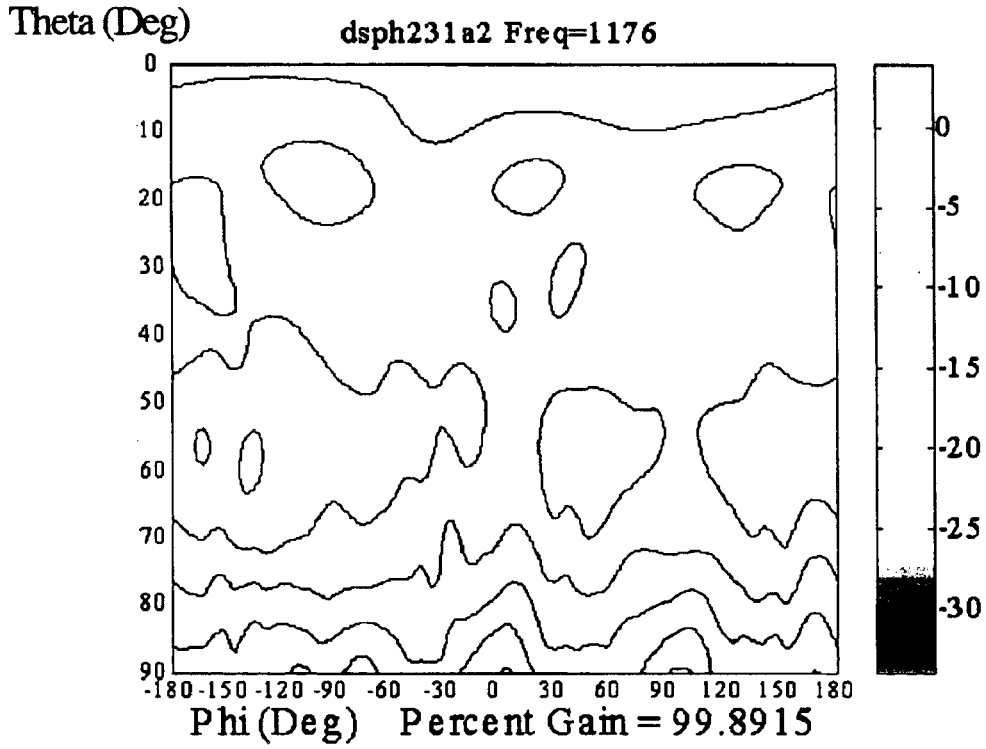
FIGS. 6*a*, 6*b*, and 6*c* are plots of measured percentage gain patterns in the $L_5$, $L_2$ and $L_1$ bands respectively.
Figure 6B:
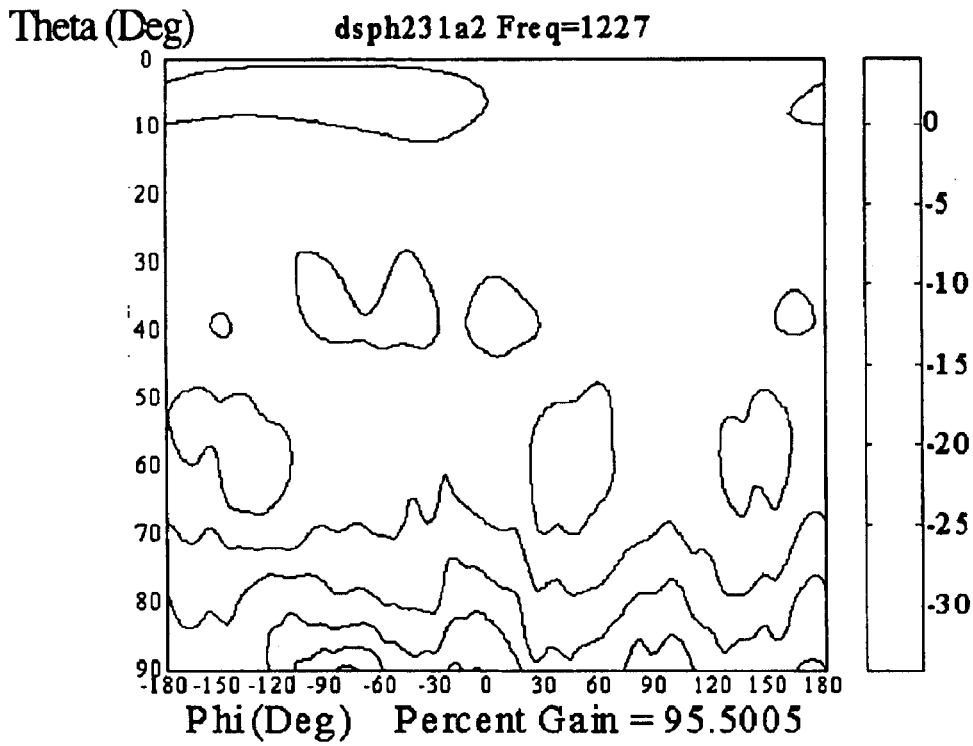
Figure 6C:
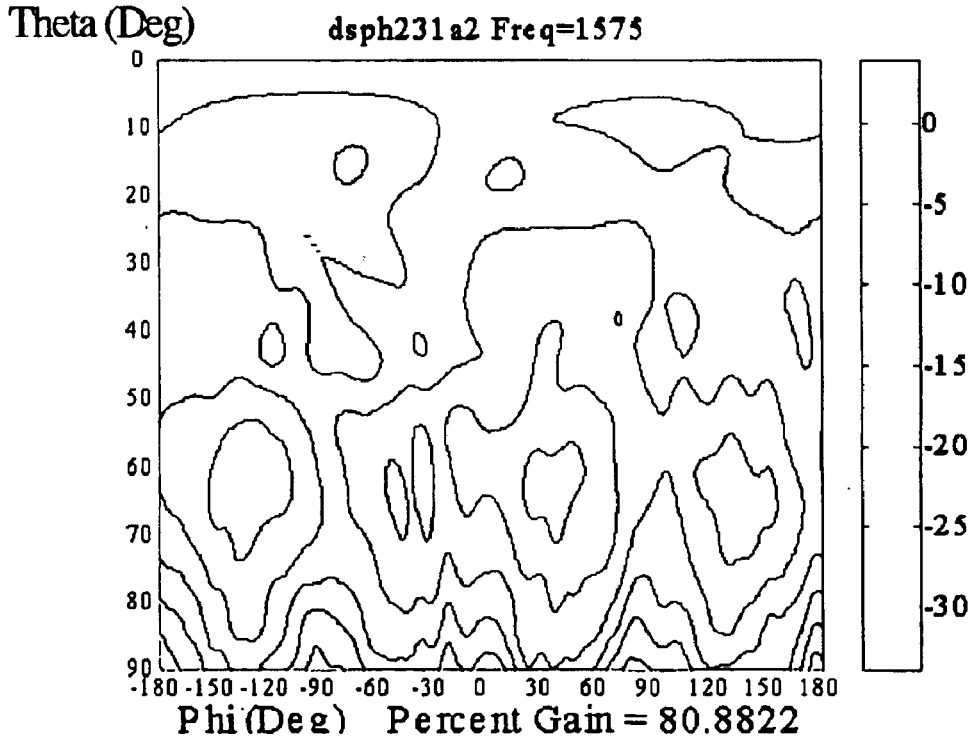

As stated above, FIG. 3 shows the measured VSWR for this antenna array. Notice the second dip in the VSWR curve centered around 1.575 GHz is caused by the presence of the $L_1$ trap filer. The first dip in the VSWR curve is broad enough to provide a VSWR of slightly greater than 2:1 in both the $L_5$ and $L_2$ frequency bands. FIGS. 4*a*, 4*b* and 4*c* show the measured input resistance and reactance in the three GPS frequency bands of interest. Notice that the reactance is low and the input resistance is between 30 and 40 ohms across all three bands obviating the need for a broadband matching network. FIGS. 5*a*, 5*b* and 5*c* show the measured RHCP (Right Hand Circular Polarization) and LHCP (Left Hand Circular Polarization) far-field radiation patterns. These radiation patterns were measured with the antenna array 10 mounted at the center of a 51" diameter rolled edge ground plane. The patterns were measured in a nearfield antenna range using a spherical scanning technique. This antenna has a good RHCP axial ratio at elevation angles above 30°. The gain does not fall off rapidly as the elevation angle decreases as in most GPS microstrip patch type antennas. The desired "Percentage Gain Coverage ($P_G$)" requirement for GPS antennas is that it provide a gain of better than −3.5 dBic over 95% of the solid angle coverage in the upper hemisphere between elevation angles of 90° and 10°. The measured percentage gain coverage $P_G$ for the antenna array 10 is 96% in the $L_5$ band, 97% in the $L_2$ band and around 80% in the $L_1$ band. The measured percentage gain patterns for the three frequency bands are shown in FIGS. 6*a*, 6*b* and 6*c*, respectively. The Y axis in these figures is the angle Theta=90°—Elevation Angle and the X axis is the angle Phi—Azimuth angle. The gain patterns shown in these three figures show the gain over the entire upper hemisphere down to the horizon. The horizon corresponds to Theta=90°. The lower RHCP gain in the $L_1$ band is caused by the frequency dispersion in the VSWR response of the four elements of the array as can be seen from the results shown in FIG. 3. PG in the $L_1$ band can be improved to meet the specified gain coverage by designing the antenna with better mechanical tolerances and by re-tuning of the trap filter and its location in the four inverted L array elements; these measures should bring the four antenna elements into relative phase synchronism to achieve a better RHCP antenna gain across the $L_1$ band.

It is thus seen that the present invention can accommodate all three frequency bands in a proposed modernization of the proposed GPS system. In particular, the four element, right-hand circularly polarized, trap loaded inverted L antenna array of the invention provides good gain coverage at the $L_1$, $L_2$, and $L_5$ frequency bands. The antenna is easy to build and is excited by a microstrip 180° hybrid used in conjunction with two 90° hybrids to proved the required phase shift between the four array elements to generate right-hand circular polarization. The array has a broad antenna pattern with a RHCP gain of better than −3.5 dBic over a major portion of the upper hemisphere down to an elevation angle of 10°. The antenna of the invention therefore provides visibility to GPS satellites even at low elevation angles ensuring good position accuracy.

Those skilled in the art will appreciate that another application for the antenna of the invention will be in the proposed European GPS satellite system known as "Galileo" that is expected to be deployed in the next few years. The frequencies that have been initially selected for the Galileo system are 1176.45 MHz (24 MHz bandwidth), 1202.025 MHz (24 MHz bandwidth), 1278.750 MHz (40 MHz bandwidth), and 1575 MHz (33 MHz bandwidth). Note that two of the selected initial frequencies are the same as for the modernized U.S. GPS system, and the other two frequencies are also well within the tuning range of the antenna invention disclosed herein. Note also that the bandwidths are much wider in all the selected frequency bands than for the corresponding U.S. GPS system because of different signal waveforms. The increased bandwidth of the proposed European system makes antenna design technically more challenging, but can be achieved through the trap loading design disclosed herein.

Those skilled in the art will also recognize that the antenna disclosed herein has application in other L-band satellite communication systems such as INMARSAT, which operate at the following frequency bands: transmit—1626.5–1660.5 MHz; receive—1530–15509 MHz. The antenna of the invention can also be used in wireless communication systems that operate at 900 MHz and 1800 MHz, although these systems need a linearly polarized system. However, RHCP can provide better performance in an urban environment because of multipath effects.

What is claimed is:

1. Antenna array comprising:

four elements arranged at 90° intervals on a dielectric substrate, each element including first and second portions disposed at a substantially right angle with respect to one another, the first portion including an RF trap filter, each element adapted to operate at three frequency bands, wherein the elements are excited with equal amplitudes but with a relative phase difference of 0°,−90°, −180°, and −270° to achieve right-hand circular polarization.

2. The antenna array of claim 1 wherein the RF trap filter presents a high impedance with respect to one of the three frequency bands.

3. The antenna array of claim 2 wherein the three frequency bands include two bands relatively closely separated from each other with a third band more widely separated from the other two bands, wherein the RF trap filter presents a high impedance with respect to the third band.

4. The antenna array of claim 3 wherein the three frequency bands are GPS bands.

5. The antenna array of claim 4 wherein the three frequency bands are approximately centered on 1176, 1227, and 1575 MHz.

6. The antenna array of claim 5 wherein the trap filter is adapted to bring each element into resonance at approximately 1575 MHz.

7. The antenna array of claim 1 wherein the dielectric constant of the dielectric substrate is approximately 1.07.

8. The antenna array of claim 1 wherein the sum of the lengths of the first and second portions equals approximately $\lambda/4$.

9. The antenna array of claim 7 wherein the dielectric substrate is foam having a permittivity of approximately 1.07.

10. The antenna array of claim 1 wherein the RF trap filter is a capacitor in parallel with an inductor.

11. The antenna array of claim 10 wherein the inductor is a high Q inductor.

12. The antenna array of claim 10 wherein the capacitor has a capacitance of approximately 2.2 picofarad and the inductor has an inductance of approximately 2.8 nanohenry.

13. The antenna array of claim 1 wherein the dielectric substrate is a square with an element disposed in the middle of each side of the square.

* * * * *